United States Patent [19]

Sandham

[11] 4,099,774

[45] Jul. 11, 1978

[54] STENOGRAPHER'S CHAIR

[75] Inventor: Edwin C. Sandham, Thiensville, Wis.

[73] Assignee: Leggett & Platt, Incorporated, Carthage, Mo.

[21] Appl. No.: 761,683

[22] Filed: Jan. 24, 1977

[51] Int. Cl.[2] ..... A47C 7/02

[52] U.S. Cl. ..... 297/298; 297/353; 297/443; 297/306

[58] Field of Search ..... 297/452, 443, 444, 455, 297/DIG. 1, DIG. 2, 383, 355, 306, 298

[56] References Cited

U.S. PATENT DOCUMENTS

| | | | |
|---|---|---|---|
| 1,276,661 | 8/1918 | Kamrass | 297/455 |
| 2,031,883 | 2/1936 | Gedris | 297/455 X |
| 2,960,152 | 11/1960 | Wendel | 297/455 |
| 3,026,145 | 3/1962 | Galbraith | 297/455 |
| 3,111,689 | 11/1963 | Mulhauser | 297/DIG. 1 |
| 3,288,529 | 11/1966 | Koch | 297/444 X |
| 3,722,954 | 3/1973 | Rey et al. | 297/452 |
| 3,807,800 | 4/1974 | Morrison et al. | 297/452 |
| 3,851,920 | 12/1974 | Harris et al. | 297/455 |
| 3,907,363 | 9/1975 | Baker et al. | 297/455 X |
| 4,023,860 | 5/1977 | Harder | 297/444 |

*Primary Examiner*—Francis K. Zugel
*Attorney, Agent, or Firm*—Wood, Herron & Evans

[57] ABSTRACT

A chair having a novel structure by which the seat cushion and backrest cushion are attached to the chair frame. The chair includes a novel first adjustment device by which the horizontal position of the backrest, and the rearward tilt pressure of the backrest, may be varied by manual operation of the same structural element. The chair also includes a novel second adjustment device located interiorly of the backrest by which the backrest can be vertically positioned relative to the seat.

12 Claims, 4 Drawing Figures

STENOGRAPHER'S CHAIR

This invention relates to chairs and particularly to business or office type chairs.

There are numerous different types of office chairs, one specific recognizable type to the trade being known as a stenographer's chair. The various features of the chair invention illustrated and described in this application are done so in connection with a stenographer's chair. However, it will be apparent to those skilled in the art that the features disclosed and claimed are equally applicable to other type business or office chairs.

In the manufacture of office chairs and, in particular, in the manufacture of less expensive office chairs such as stenographer's chairs, it is important to provide a structure that is relatively inexpensive to produce, and easy and simple to operate by the user, yet which provides the primary chair functions required by customer demand. In terms of useful life of such a chair, it is recognized that the fabric with which the chair's seat and backrest are covered may become worn in use, or may become undesirable from a decor standpoint after a period of time, thereby requiring recovering of those chair components with a new fabric material. In connection with the chair's primary functions, it is desirable that the backrest on the chair be horizontally adjustable as well as vertically adjustable, relative to the seat so that the chair can be conformed to the user at the use location. It is now commonplace in certain types of chairs to include a separate mechanism that permits the backrest to tilt rearwardly relative to the seat when the user leans back against the backrest. With reference to this backrest tilt function, it is also desirable that the backrest be provided with a device that permits variance, as desired by the user, of the rearward tilt pressure on the backrest necessary to tilt that backrest.

In light of the above, it has been one objective of this invention to provide a chair which includes at least one of a novel seat and backrest structure, that structure including a seat or backrest readily and easily engageable and disengageable from a seat or backrest shell, respectively, thereby promoting simplified manufacture of the chair in the first instance, and ease of replacement of the chair fabric in the second instance.

It has been another objective of this invention to provide a novel device for a chair that permits, through a single hand operated element and as desired by the user, horizontal positioning of the chair's backrest relative to the chair's seat, as well as variation of the rearward tilt pressure necessary to tilt the backrest.

It has been still another objective of this invention to provide a novel device for a chair that permits the chair's backrest to be vertically positioned as desired relative to the chair's seat, that device being wholly enclosed between the backrest's cushion and the backrest's support shell except for a finger latch exteriorly exposed for manual operation by the user.

Other objectives and advantages of this invention will be more apparent from the following detailed description taken in conjunction with the drawings in which:

FIG. 3 is a cross-sectional view taken along line 3—3 of FIG. 2.

Figure 1:
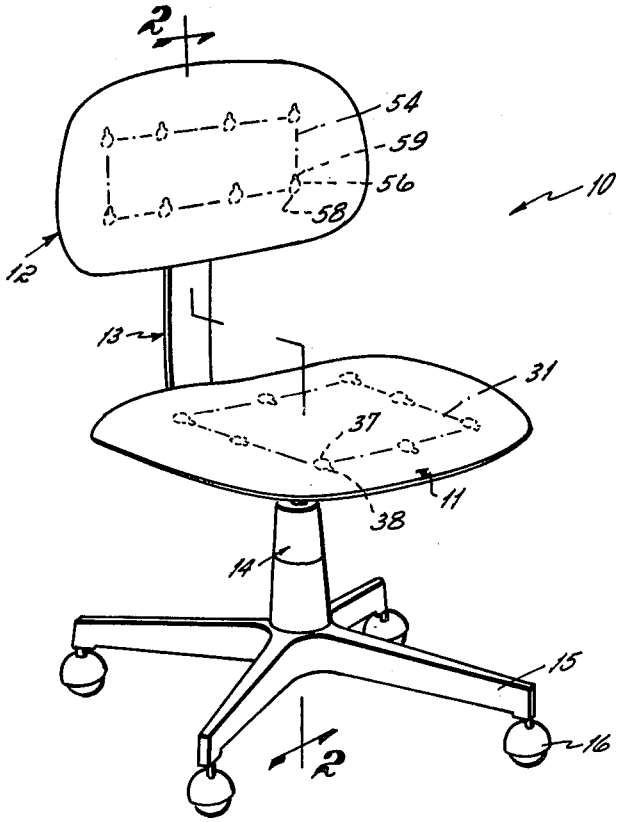
FIG. 1 is a perspective view illustrating a stenographer's chair in accord with the principles of this invention.

As illustrated in FIG. 1, the chair 10 of this invention is particularly illustrated in the form of a stenographer's chair. The stenographer's chair 10 includes a seat 11 and a backrest 12, the backrest being connected to the seat by a support arm 13. The seat 11 is mounted for rotational movement at the top of centerpost 14, star legs 15 extending radially outward from the bottom of that centerpost. Casters 16 are provided at the outer ends of the star legs 15. The centerpost 14 and legs 15 provide no part of this invention, and may be of any structure well known to the art. The centerpost 14 is preferably structured so that the seat 11 (and, hence, the backrest 12) may be vertically adjusted as desired by the user, and so that the seat may be rotated as desired by the user without affecting that vertical adjustment, such structures being well known to the prior art.

Figure 2:
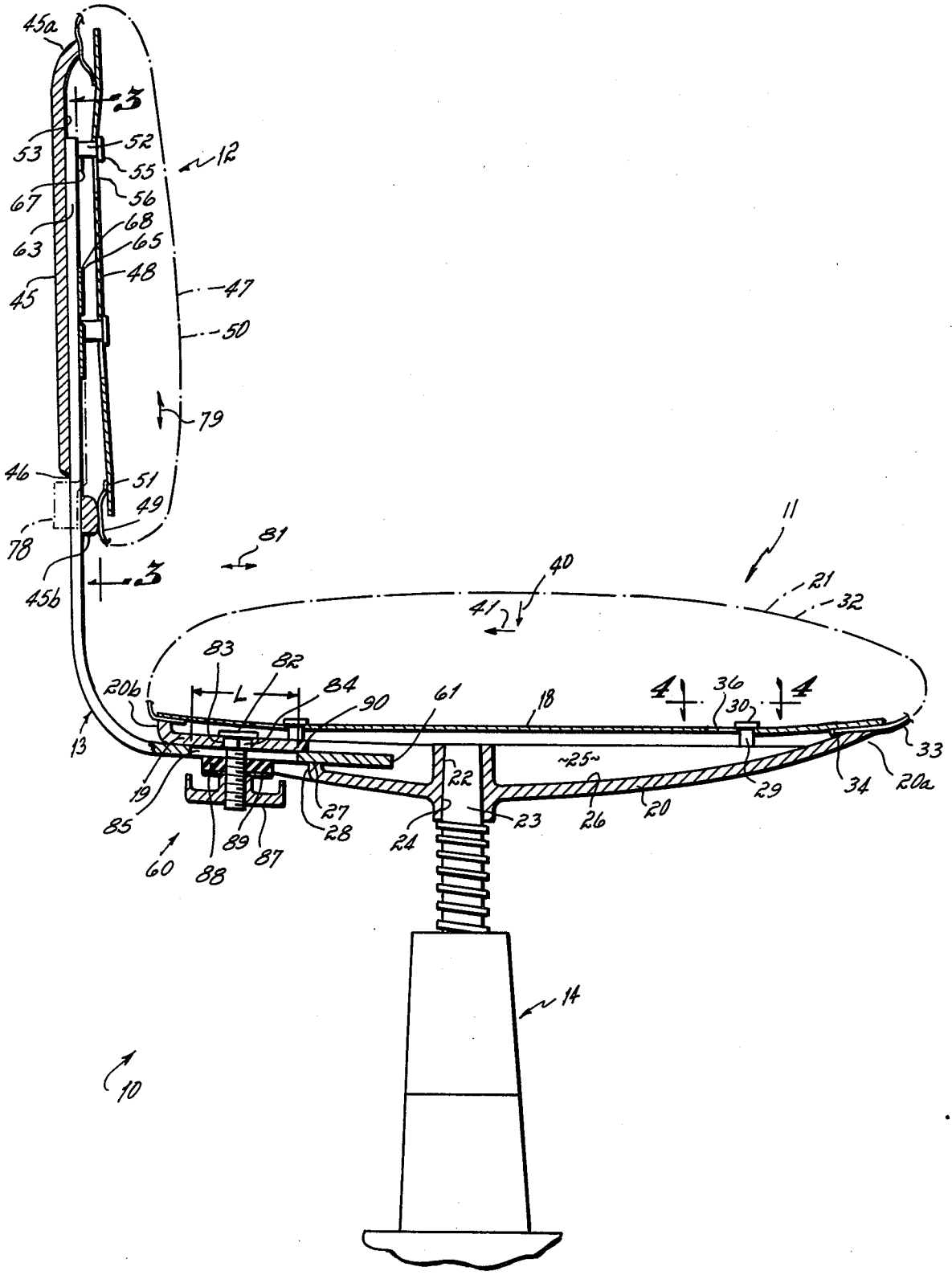
FIG. 2 is a cross-sectional view taken along line 2—2 of FIG. 1.

As shown in FIG. 2, the chair's seat 11 basically includes a seat pan or shell 20 on which is mounted a seat cushion 21. The seat shell 20 is of a concave configuration, and is preferably an aluminum die casting. The seat shell 20 is provided with a tapered socket 22 generally centrally thereof, the tapered socket 22 being adapted to receive a threaded spindle 23 in press-fit relation as illustrated at 24. The threaded spindle 23 rotates the chair's centerpost 14, in accord with structure known in the prior art. The seat shell 20 itself may be provided with a plurality of ribs 25 extending generally radially and outwardly from the tapered socket 22 on the inner surface 26 of the shell, the ribs being provided for reinforcement or strength purposes and the top edges **25*a* of the ribs defining a support surface for plate-shaped member 18. Note the support surface 25*a* is positioned below the rigid shell's peripheral edge 20*a*, 20*b* relative to the floor 20*c* of the rigid shell 20 as shown in FIG. 1. A slot 27 is defined in the seat shell 20 adjacent the rear edge 20*b* thereof, the slot 27 being generally parallel to the front edge 20*a* and rear edge 20*b* of the seat shell. The slot 27 is defined by an upturned lip 28 and generally horizontal ledge 19, the lip and ledge being integral with and cast into the die cast shell 20. The slot 27 is adapted to receive the backrest's support arm 13** as described in detail below.

First connector means in the form of a plurality of studs 29 are also cast integral with the seat's shell 20, the studs extending upwardly from the inner surface 26 of the shell. Each stud 29 is of a first or minor diameter to which is assembled a head 30 at the top thereof that is of a larger second or major diameter, the studs and heads being essentially T-shaped in cross section as illustrated. The general pattern or outline 31 of the T-shaped studs on the seat shell 20 is illustrated in phantom lines in FIG. 1. It is by means of the T-shaped studs 29 and heads 30 that the seat cushions 21 are attached to the seat shell 20, thereby establishing the chair's seat 11. Note that the studs 29 are immobile relative to the ridge shell 20.

The seat cushion 21 includes a generally planar foundation member 18 that is at least slightly flexible. The foundation member 18 may be fabricated of fiberboard or sheet metal or the like. The foundation member 18 is, of course, generally configured in peripheral outline in the same general shape as that of the seat shell 20 itself. The foundation member 18 carries a cushioning material 32 such as foam rubber, the foam rubber being covered by a fabric 33 that is lipped, as at 34, over the side edges of the foam rubber, and onto the bottom surface of the foundation member, around the external periphery of that foundation member. The covering material or fabric 33 is secured to the flexible foundation sheet 18 on the underside thereof by staples or by adhesive or in any other suitable manner. Note particularly, as illustrated in FIG. 1, that the seat's foundation 18 defines second connector means in the form of a pattern 31 of holes 36 therein which conform to the pattern 31 of studs 29 integral with the seat shell 20. Each of the holes 36 is asymmetrical in configuration, a first port or access port 37 being generally circular and of a diameter larger than the diameter of the circular stud head 30, and a second port or throat 38 being elongated and of a width less than the diameter of the stud head 30 but at least as great as the diameter of the stud post 29. Note that the throats 38 are all angled in the same direction one to another, i.e., the axes of all throats are parallel one to the other and that the holes 36 are immobile relative to the foundation sheet 18.

Figure 4:
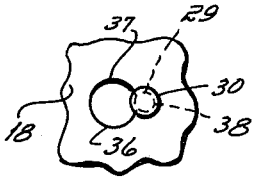
FIG. 4 is a cross-sectional view taken along line 4—4 of FIG. 2.
Figure 5:
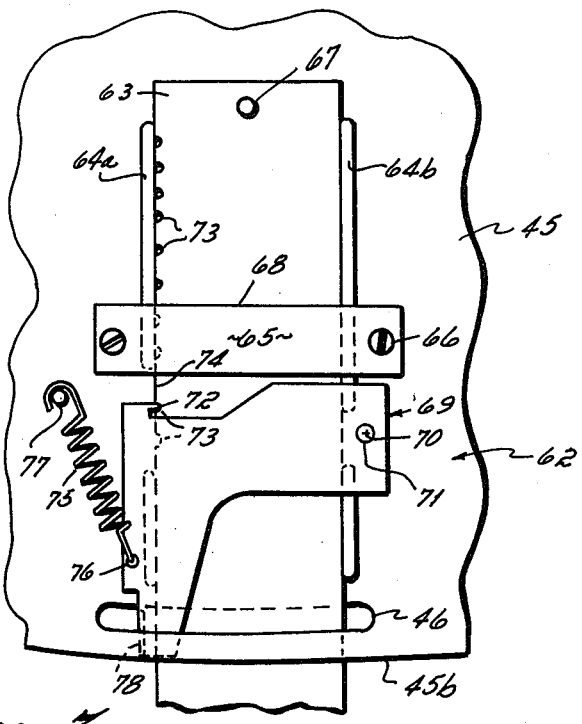

It is by means of these holes 36 in the seat's foundation plate 18 by which the seat cushion 21 itself is operatively attached to the seat shell 20. To achieve such attachment upon initial assembly, the large diameter openings 37 in the seat cushion's foundation 18 are simply positioned over the studs 29 integral with the seat shell 20. The seat cushion 21 is then depressed in a location generally centrally of the cushion so as to locate the stud heads 30 in a plane above the plane of the foundation 18 in those areas adjacent to all studs 29. This first step is generally accomplished by pushing downwardly in accord with the directional arrow 40 so as to flex the peripheral portion of foundation plate 18. Thereafter, the seat cushion 21 is then pushed rearwardly toward the rear edge **20*b* of the seat shell 20, thereby disposing the studs 29 in the throats 38 of the foundation's holes 36, see FIG. 4. This is generally accomplished by pushing the seat cushion 21 rearwardly in accord with directional arrow 41. In this attitude, stud heads 30 prevent vertical disengagement of the foundation 18 (and, hence, the seat cushion 21) from the seat shell 20 and the flexure of the foundation plate 18, as maintained by the stud heads 30, restrains lateral displacement of the foundation 18 and attached seat cushion. The installed posture of the seat cushion 21 on the seat shell 20 is illustrated in FIG. 2. Note particularly that the holes 36 in the seat cushion's foundation 18 are oriented so that the throats 38 thereof are ahead of the access holes 37 thereof relative to the leading edge 20*a* and of the seat shell 20. This helps to insure that the seat cushion 21 will not become disengaged from the seat shell's studs 29 as a person sits down on same in use. Thus, the seat cushion 21 is affixed to the seat shell 20 in a manner that permits the cushion to be retained on the seat shell during use, but also permits the cushion to be removed from the seat shell for recovering of the cushion material 32 and foundation 18 if desired at some future date. Note that in the FIG. 2 connected position, a gap G is defined between plate-shaped member 18 and the support plane 25*a* of the rigid shell 20 to permit foundation member 18 to flex toward the shell 20** when disconnection is desired.

The backrest 12 construction is illustrated in FIGS. 2 and 3. As illustrated in FIG. 2, the backrest 12 includes a backrest shell 45 having a top edge **45*a* and a bottom edge 45*b* thereof, that shell defining a slot 46 adjacent the bottom edge. The slot 46 is, in effect, cast integral with the shell 45 as the shell itself is preferably an aluminum die casting. The backrest cushion 47 is fabricated of the same type general construction as illustrated for the seat cushion 21. The backrest cushion 47 includes a slightly flexible foundation member 48 of plate-shaped configuration generally similar to the periphery of the backrest shell 45. The foundation 48 may be fabricated of fiberboard or sheet metal or other material. A fabric 49 covers cushioning material 50 and is lapped over, as at 51, onto the underside of the foundation around the entire periphery thereof, the fabric being secured to the foundation with staples or adhesive, or the like. As was the case with the seat shell 20, the backrest shell 45 also includes a plurality of studs 52 extending forward from the inner surface 53 thereof in a pattern 54. To each of the studs 52 is assembled a circular head member 55, thereby providing a generally T-shape in cross section to the studs. As with the studs 29 for the seat shell 20, each of the backrest shell's studs 52 has a diameter less than the diameter of its head 55**.

The backrest cushion 47, as was the case with the seat cushion 21, includes a plurality of asymmetrical pan-shaped holes 56 in its foundation plate 48, those holes 56 being positioned in the same pattern as the pattern 54 for the studs 52 affixed to the backrest shell 45. Each of the holes 56 includes a large diameter access hole section 58 and a narrow width throat section 59. Again, and as with the holes 36 in the seat cushion's foundation 18, the throats' axes are all oriented parallel one to the other, and all face upwardly relative to the top edge **45*a* of the backrest shell 45 as illustrated in FIG. 1. In assembly of the backrest cushion 47 with the backrest shell 45, that cushion 47 is assembled in the same general manner as described in connection with assembly of the seat cushion 21 to the seat shell 20, i.e. by flexing the foundation plate 18 while simultaneously forcing the narrow portion or throats of the holes downwardly over the head members 55 of the studs 52 thereby defining a gap G after assembly that permits easy dissembly when required. Since the holes' throats 59 in the backrest cushion's foundation 48 all face up, disassembly of the backrest cushion 47 from the backrest shell 45** upon use is not possible as a user sits down thereon.

The backrest 12 is attached to the seat 11, as previously mentioned, through a support arm 13 fabricated of, for example, steel. A first adjustment device 60 connects one end 61 of that arm 13 with the seat 11, and a second adjustment device 62 connects the other end 63 of that arm 13 with the backrest 12.

With respect to the second or vertical positioner device 62, and as illustrated in FIGS. 2 and 3, that device 62 permits the backrest 12 to be vertically adjusted relative to the seat 11, i.e., to be slidingly adjusted along the top end 63 of the support arm 13. It is important that the backrest 12 be vertically positionable at different desired positions relative to the seat 11, that position depending upon the height of the person using the chair, of course. The support arm's top end 63 extends into the interior of the backrest 12, i.e., between the backrest shell's inner surface 53 and the backrest cushion's foundation 48, as illustrated in FIG. 2, the top end 63 extending into the backrest interior through slot 46 defined in the backrest shell 45. Within the backrest's interior, the support arm 13 is maintained in operative relation by guide ribs **64*a*, 64*b* on opposed sides thereof formed integral with the backrest shell 45, the guide ribs preventing the backrest from angulating or pivoting in the plane of the backrest, see FIG. 3**. Further, a cross strap 65 is fixed to overlie the support arm 13 within the interior of the backrest 12, the cross strap being fixed to the backrest shell 45 by screws 66, see FIG. 3. The cross strap 65, and that portion of the shell 45 itself that defines the slot 46, cooperate to hold the support arm 13 in position relative to the plane of the backrest 12. A stop pin 67 is provided at the top end of the support arm 13, the stop pin being adapted to coact with the top 68 edge of the cross strip 65 to prevent the backrest 12 from being completely disengaged from the support arm.

The vertical positioner device 62 also includes a latch lever 69 pivotally mounted, on pivot axis 70 by screw 71, to the backrest shell 45 on the inside surface 53 of that shell. The latch lever 69 includes a detent 72 adapted to cooperatively engage one of a series of notches 73 provided on one edge 74 of the support arm 13. The latch lever 69 is continuously biased by a tension spring 75, that spring being connected to the latch lever as at 76 and to stud pin 77 at the other end (the stud pin being cast integral with the backrest shell 45). The tension spring 75 continuously spring loads the latch lever's detent 72 into latching relation with the support arm's notched edge 74, thereby restraining the backrest 12 in the desired vertical position relative to the chair's seat 11. The latch lever 69 also includes a thumb 78 that extends outside of the backrest shell 45 through the shell's slot 46. It is by use of the thumb 78 that the latch lever 69 is released from latched engagement with the support arm 13, thereby permitting the backrest to be adjusted upwardly or downwardly, in accord with directional arrow 79, along that support arm as desired by the user. The latch lever's thumb 78 is the only structural component of the vertical positioner device 62 which is exterior of the backrest 12.

The other end 61 of the backrest support arm 13 (and, hence, the backrest 12 itself) is connected with the chair's seat by a first or dual function adjustment device 61 particularly illustrated in FIG. 2. The dual function device 61 permits the horizontal location of the backrest 12 to be varied, in accord with directional arrow 81, relative to the chair's seat 11 as desired by the user. The dual function device 61 also permits the required pressure to tilt the backrest 12 relative to the seat 11 to be varied as desired by the user. This dual function device 62 includes a bolt 82 which extends through square hole 83 in the seat shell 20, the bolt being provided with a square shank portion 84 which seats in the square hole in the seat shell to prevent rotation of the bolt. The bolt 82 extends through a slot 85 provided in the support arm 13, the slot being of a length L that provides a suitable adjustment range for locating the backrest in various horizontal positions relative to the seat 11. Note particularly that the backrest support arm 13 extends through slot 27 defined in the one-piece seat shell 20. The slot 27 structure of the seat shell 20 and the bolt 82 structure provides the connection for the support arm 13 with the seat 11, that structure being configured and sized to prevent side-to-side sway of the backrest 12 relative to the seat. A handwheel 87 is cooperatively engaged with the bolt 82 for restraining the support arm 13 in operative engagement with the seat shell. A spring 88 of rubber or other material is interposed between the handwheel 87 and the support arm 13, a washer 89 being provided between the spring and the handwheel to provide a rigid bearing surface for the handwheel. The rubber spring 88 is of an annular washer-like configuration. Adjustment of the backrest 12 horizontally relative to the seat 11 is accomplished by loosening the handwheel 87 and sliding the support arm 13 toward or away from the seat, this sliding motion being permitted by virtue of the interengagement of the support arm and bolt 82 through support arm's slot 85. Once the desired horizontal position is achieved for the backrest 12, the handwheel 87 is simply tightened. The pressure required of the chair's user to back tilt the backrest 12 is adjusted by varying the tightness of the handwheel 87 against the support arm 13, it being recalled that the spring 88 is interposed therebetween. The tighter the handwheel 87 against the support arm 13, the stiffer the backrest 12, i.e., the greater the pressure required to tilt the backrest relative to the seat 11. The looser the handwheel 87 relative to the support arm 13, the less pressure required to tilt the backrest 12 relative to the seat 11. Thus, the back tilt pressure for the backrest 12 is controlled by operation of the handwheel 87 against the spring 88. The fulcrum point for tilting of the backrest 12 relative to the seat 11 is illustrated at 90, and is defined by cooperative interrelation of the support arm 13 with the seat shell 20 itself.

Having described in detail the preferred embodiment of my invention, what I desire to claim and protect by Letters Patent is:

1. A chair having at least one of a seat and backrest, said one of said seat and backrest comprising a rigid shell, said rigid shell having a peripheral edge configuration generally shaped as said one of said seat and backrest, and said rigid shell including a support surface, said support surface being positioned below said rigid shell's peripheral edge relative to the floor of said rigid shell, a flexible plate-shaped member that serves as the foundation for a cushion, said plate-shaped member being sized to overlie said peripheral edge of said shell, said plate-shaped member being adapted to flex toward said shell when overlying said shell's peripheral edge in response to a centrally disposed force thereon and being adapted to flex away from said shell in response to release of said force thereon, and connector means connecting said plate-shaped member and said rigid shell, said connector means being partially carried on said plate-shaped member and partially carried on said shell, that portion of said connector means carried on said plate-shaped member being immobile relative thereto and that portion of said connector means carried on said rigid shell being immobile relative thereto, said connector means being structured to permit connection and disconnection by flexing said plate-shaped member toward said rigid shell and thereafter moving said plate-shaped member relative toward said shell's peripheral edge while retaining said plate-shaped member in the flexed attitude, and said connector means being structured to define a gap between said plate-shaped member and said support surface on said rigid shell when said plate-shaped member and said rigid shell are connected for permitting said plate-shaped member to flex toward said rigid shell when disconnection is desired, thereby permitting said plate-shaped member to be connected in and disconnected from final use position with said rigid shell.

2. A chair as set forth in claim 1, said plate-shaped member being restrained in a flexed attitude after connecting said connector means for aiding in restraining lateral displacement of said plate-shaped member relative to said rigid shell.

3. A chair as set forth in claim 2, said connector means comprising a plurality of rigid studs immobily fixed to one of said shell and said foundation member, said studs being generally T-shaped in cross section with the heads of said studs being larger than the posts of said studs, and structure defining a plurality of holes in the other of said shell and said foundation member, said holes being arranged in a pattern generally the same as the pattern defined by said studs, each hole including an access portion through which the head of a stud is adapted to project, and each hole including a throat portion in which a stud's post is received through which the stud's head cannot pass, said stud's head overlying said foundation member to restrain said plate-shaped member in operative assembly with said shell when said stud's posts are received in said hole's throat portions.

4. A chair as set forth in claim 3 in which said rigid shell is generally shaped as a seat, said holes being oriented so that the throats thereof are ahead of the access portions thereof relative to the leading edge of said seat, thereby preventing disengagement of said connector means when a user sits down on said chair after said plate-shaped member has been connected to said rigid shell.

5. A chair as set forth in claim 3 in which said rigid shell is generally shaped as a backrest, said holes being oriented so that the throats thereof are above the recess portion relative to the top edge of said backrest, thereby preventing disengagement of said connector means when a user sits down on said chair after said plate-shaped member has been connected to said rigid shell.

6. A chair as set forth in claim 1, said chair comprising a first adjustment device connected to said seat shell by which the horizontal position of said backrest relative to said seat, and by which the rearward pressure necessary to tilt said backrest relative to said seat, may be varied by manual operation of a single structural element.

7. A chair as set forth in claim 6, said seat including a rigid shell adapted to support a seat cushion, said first adjustment device comprising a slot defined in said shell, a support arm for said backrest received in said shell slots, said support arm and said shell defining a fulcrum point about which said backrest is adapted to tilt, and a variable pressure structure interconnecting said support arm and said shell, said variable pressure structure being adjustable to vary the tilt pressure required to tilt said backrest rearwardly about said fulcrum point.

8. A chair as set forth in claim 7, said first adjustment device also comprising a slot defined in said support arm, said support arm slot permitting said backrest to be moved relative to said seat, said variable pressure structure connecting said support arm to said shell through said support arm slot.

9. A chair as set forth in claim 8, said variable pressure structure including a compression spring disposed beneath said support arm, and a manually rotatable element connected to said shell through said support arm slot, said element being adapted to compress said spring against the underside of said support arm.

10. A chair as set forth in claim 1, said chair being of the type having a backrest and a seat, said backrest being vertically adjustable relative to said seat, said chair comprising a backrest shell adapted to receive a backrest cushion in fixed relation therewith, said shell being rigid, structure defining a slot in said backrest shell adjacent one edge thereof, a support arm adapted to be received within said backrest through said backrest shell slot, a vertical positioner device within said backrest, said vertical positioner device being selectively operable to permit the vertical positioning of said backrest relative to said seat to be varied as desired, and a manually operable trigger element connected to said vertical positioner device for operating said vertical positioner device, said trigger element being exteriorly of said shell.

11. A chair as set forth in claim 10, said vertical positioner device including a latch member positioned within said backrest, said latch member defining a detent thereon, and notch structure defined on a portion of said support arm within said backrest, said detent cooperating with said notch structure to retain the backrest in the vertical position desired.

12. A chair as set forth in claim 11 further including spring means positioned within said backrest, said spring means being adapted to continuously bias said latch member detent into latching engagement with one of said support arm's notches.

* * * * *